US011306536B2

(12) United States Patent
Bennion et al.

(10) Patent No.: US 11,306,536 B2
(45) Date of Patent: Apr. 19, 2022

(54) DOWNHOLE MOTOR ASSEMBLIES, SYSTEMS AND METHODS

(71) Applicant: Phoenix Drill Tools, Inc., Salt Lake City, UT (US)

(72) Inventors: Brock Bennion, Salt Lake City, UT (US); Kyle Evans, Salt Lake City, UT (US)

(73) Assignee: Phoenix Drill Tools, Inc., Salt Lake City, UT (US)

( * ) Notice: Subject to any disclaimer, the term of this patent is extended or adjusted under 35 U.S.C. 154(b) by 8 days.

(21) Appl. No.: 16/999,389

(22) Filed: Aug. 21, 2020

(65) Prior Publication Data

US 2021/0054694 A1 Feb. 25, 2021

Related U.S. Application Data

(60) Provisional application No. 62/889,934, filed on Aug. 21, 2019.

(51) Int. Cl.
*E21B 4/02* (2006.01)
*E21B 4/00* (2006.01)

(52) U.S. Cl.
CPC ..... *E21B 4/003* (2013.01); *E21B 4/02* (2013.01)

(58) Field of Classification Search
CPC ..... E21B 4/003; E21B 4/00; E21B 4/02
See application file for complete search history.

(56) References Cited

U.S. PATENT DOCUMENTS

| | | | | |
|---|---|---|---|---|
| 8,033,920 | B1 | 10/2011 | Benson | |
| 2012/0228035 | A1 | 9/2012 | Gillis | |
| 2012/0285748 | A1 | 11/2012 | Kirkhope | |
| 2013/0319764 | A1* | 12/2013 | Schaaf | E21B 7/06 175/24 |
| 2014/0251695 | A1* | 9/2014 | Marchand | E21B 7/068 175/74 |
| 2016/0273276 | A1 | 9/2016 | Baudoin | |
| 2016/0319883 | A1 | 11/2016 | von Gynz-Rekowski et al. | |
| 2016/0326863 | A1* | 11/2016 | Lange | E21B 47/02 |

OTHER PUBLICATIONS (ISA/US) "Notification of Transmittal of the International Search Report and the Written Opinion of the International Searching Authority, or the Declaration," PCT/US20/47355, dated Nov. 3, 2020.

* cited by examiner

*Primary Examiner* — Taras P Bemko
(74) *Attorney, Agent, or Firm* — Bretton L. Crockett; TechLaw Ventures, PLLC

(57) ABSTRACT

The present disclosure is directed to improved downhole motor designs. In one illustrative embodiment, primary and secondary thrust bearings that are maintained in position by other structural components of the motor without compressive loading of the entire bearing assembly are positioned inside the motor housing for protection from cuttings and debris in the drilling fluid. In some illustrative embodiments, a drive train that features at least one multi-part sectional flex joint may allow for a shortened flex shaft while sufficiently converting eccentric forces from the power source to rotation of the mandrel.

20 Claims, 3 Drawing Sheets

DOWNHOLE MOTOR ASSEMBLIES, SYSTEMS AND METHODS

CROSS-REFERENCE TO RELATED APPLICATION

This application claims the benefit of U.S. Provisional Application No. 62/889,934, filed Aug. 21, 2019, which is incorporated herein by reference in its entirety, including but not limited to those portions that specifically appear hereinafter.

BACKGROUND

In some applications, rotational power for a downhole bit can be transmitted from a rotational power source at the surface via a drive shaft system that may include universal joints, CV joints, or a sectional drive system to allow for flexion, but requires the entire length of the deployed string to rotate. Other approaches use a downhole "mud motor" that on a deployed string operates to provide rotational power near the operative device (such as downhole drill). While there are numerous designs, most include a number of different bearing assemblies that must be "pre-loaded" for sealing and to operate at the desired conditions.

Downhole motors, while taking various forms, generally comprise an outer housing which is fixed (generally by a threaded connection) to the drillstring, and a rotatable mandrel (sometimes referred to as a drive sub) positioned within the housing and extending from the lowermost end of the housing. It is the mandrel that is rotated by means of fluid circulation through the drillstring and through the downhole motor. The drill bit is connected to the lowermost end of the mandrel, which usually has a "bit box" connection thereon. The mandrel therefore is free to rotate with respect to the housing yet is fixed longitudinally within the housing.

Forces between the housing and the mandrel are both radial (side-to-side) and axial or thrust loads (acting along the longitudinal axis of the downhole motor). Radial bearings are positioned within the housing, between the housing and the mandrel, to take up the radial loads.

Thrust loads may be further separated into (1) loads or forces tending to push the mandrel out of the housing; and (2) loads or forces tending to push the mandrel up into the housing, or said another way, which are transferred from the housing to the mandrel to force it downward, such as to impose weight on the bit during drilling. With regard to the first category of thrust load, thrust bearings are positioned within the housing to sustain loads tending to force the mandrel axially out the lower end of the housing; such loads are generated by fluid circulation with the bit off bottom (such fluid pressure tending to push the mandrel out of the housing), or by pulling on the drill string with the bit and/or mandrel stuck in the hole. These thrust bearings are known as "off-bottom bearings" or as secondary thrust bearings.

With respect to the second category of thrust load, in order to transmit a load to the drill bit, drillstring weight is transferred first to the housing, and from the housing to the mandrel, and thence to the drill bit. This downward weight or force transfer between the housing and mandrel is done by one or more thrust bearings, which are known as "on-bottom bearing" or primary thrust bearings.

Most mud motor designs require that one or both of the thrust bearings which are often in a thrust bearing stack be compressively loaded prior to use for functionality. This can require additional components to achieve and maintain the "pre-load" compression. Typically, this is accomplished by "pre-loading" the entire bearing assembly by mechanically locking the entire assembly together to apply torque through the entire assembly. The torque applied can be quite large, which forces can lead to excessive wear and can cause issues with changes in temperature during use. Additionally, most designs use a flexible drive shaft or "flex shaft" that is an elongated member of sufficient length and flexibility to account for eccentric motion during rotation.

Downhole motors, motor systems, and methods that do not require an applied "pre-load" would be an improvement in the art. Such a motor or components that can address or compensate for eccentric variances and/or allowed for a shorter length would be an additional improvement in the art.

SUMMARY

The present disclosure is directed to improved downhole motor designs. In one illustrative embodiment, primary and secondary thrust bearings that are maintained in position by other structural components of the motor without compressive loading of the entire bearing assembly are positioned inside the motor housing for protection from cuttings and debris in the drilling fluid. In some illustrative embodiments, a drive train that features at least one multi-part sectional flex joint may allow for a shortened flex shaft while sufficiently converting eccentric forces from the power source to rotation of the mandrel.

BRIEF DESCRIPTION OF THE DRAWINGS

Non-limiting and non-exhaustive implementations of the disclosure are described with reference to the following figures, wherein like reference numerals refer to like parts throughout the various views unless otherwise specified. It will be appreciated by those of ordinary skill in the art that the various drawings are for illustrative purposes only. The nature of the present disclosure, as well as other embodiments in accordance with this disclosure, may be more clearly understood by reference to the following detailed description, to the appended claims, and to the several drawings.

DETAILED DESCRIPTION

Figure 1A:
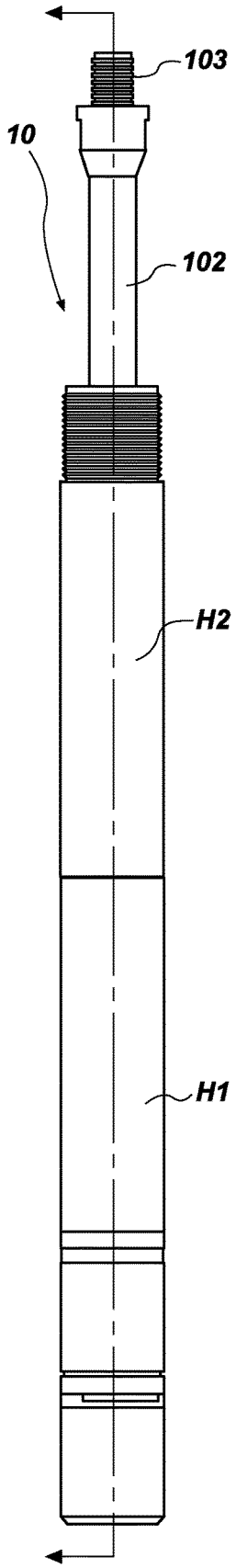
FIGS. 1A and 1B depicts a side view, and a sectional side view, respectively, of a first illustrative embodiment of a drive unit for a downhole motor in accordance with the present disclosure.

A detailed description of systems and methods consistent with embodiments of the present disclosure is provided below. While several embodiments are described, it should be understood that this disclosure is not limited to any one embodiment, but instead encompasses numerous alternatives, modifications, and equivalents. In addition, while numerous specific details are set forth in the following description in order to provide a thorough understanding of the embodiments disclosed herein, some embodiments may be practiced without some or all of these details. Moreover, for the purpose of clarity, certain technical material that is known in the related art has not been described in detail in order to avoid unnecessarily obscuring the disclosure.

Turning to FIGS. 1A, 1B, 2A and 2B, a first illustrative embodiment of a drive unit 10 for a downhole motor in accordance with the present disclosure is depicted. It will be appreciated that the drive unit may be connected to a stator housing (not shown) that includes a top sub for attachment to a drill string, and an internal rotor that is actuated by drilling fluid. At top end of the drive unit 10, a drive shaft or flex shaft 102 may have a threaded upper end 103 for attachment to a rotor, an elongated shaft 101 and a lower end 105 that may include an internally threaded bore 107 for attachment to a flexible joint assembly 200.

The flexible joint assembly 200 may be formed as a multi-part CV joint. In the depicted embodiment, the flexible joint assembly 200 may include three interlocking members: an upper member 300, a middle member 400 and a lower member 500. Each member has a bore, Which are commonly aligned upon assembly. A retention pin 600 extends from a lower base which may have a flat bottom to an upwardly extending shaft that passes through the commonly aligned bores. A retaining nut 602 may be threadably secured around an upper portion of the shaft. The lower surface of the retaining nut and the transition from the lower base to the shaft may be curved to allow for movement of the three interlocking members.

As depicted, the three interlocking members include respective interlocking portions which may be formed as a series of recessed splines that are separated by recesses. It will be appreciated that the splines and recesses of each interlocking portion may correspond to the recesses and splines of the counterpart interlocking portion of the adjacent interlocking member. In an assembled form, the corresponding adjacent interlocking portions of the interlocking members are inserted into one another as depicted.

Lower member 500 may have a connection portion for connection to the flex joint bottom adaptor 800, In the depicted embodiment, this may be a threaded connection. At a lower end, the bore may have a tapered opening that corresponds to the retention pin 600.

It will be appreciated that the recesses and splines of the interlocking portions of the members of the flexible joint may extend both in a generally top-to-bottom direction aligned with a long axis of the motor assembly, and in a generally lateral direction to allow the members to move in both directions, such that the flexible joint can provide rotational powered drive to the bottom adapter 800, while allowing the members 300, 400 and 500 to move angularly with respect to one another on the pin 600, providing flexibility and accounting for eccentricities in the rotation as power is applied.

It will be appreciated that in other embodiments, the internal vs. external positioning of the various interlocking portions, and the particular number and shape of the splines and recesses may vary, so long as the ability to transmit the rotational power while providing the requisite flexibility is provided. It will be appreciated that in other embodiments, one or more additional middle section member may be present to provide for increased flexibility. For example, two or three middle members could be used with a suitable one pin 600.

Bottom adaptor 800 has an upper connection portion 802, that is adapted to connect to the lower interlocking member 500, as by a threaded receptacle. At a lower end, a mandrel connection portion 804 allows for connection to the mandrel 1000, as by having a threaded receptacle accessible from the lower surface. Additionally, the lower surface may have a connection for the upper secondary thrust bearing 902. In the depicted embodiment, this may be an external thread to which the upper secondary thrust bearing 902 is secured.

It will be appreciated that the mandrel 1000, extends from a lower connection portion 1004 at a bottom, which may be a threaded receptacle allowing connection to a drill bit or other tool to which the rotational power is to be provided, to the upper end, which may include a connection structure for connection to the bottom adapter 800, such as an externally threaded portion.

The secondary thrust bearing assembly 900, includes the upper secondary thrust bearing 902 and a lower secondary thrust bearing 904, which are separated by gap 905, in the assembled condition. Each of the upper secondary thrust bearing 902 and the lower secondary thrust bearing 904, may be a ring with an opposing lateral face, in which a hardened material, such as PCD or PCBN buttons are disposed facing the opposing thrust bearing. The gap 905 may define the movement of the mandrel when taken from the "off-bottom" to the "on-bottom" position and vice versa. Where the thrust bearings are formed using PCD or PCBN "buttons" the gap 905 may be sized less than a thickness of a "button" to further reduce the likelihood that a bearing element may come unseated during operation. It will be appreciated that the "on-bottom/off-bottom" longitudinal movement of the mandrel/drive-sub is reliant on the bottom adaptor 800 to mandrel 1000 connection. The upper end of the internal bore of that adapter 800 serves as a 'stop-point' and thus defines the size of the gap 905 for longitudinal movement of the mandrel 1000. If this bore is too long, then the bottom adaptor would be able to thread down and load out the thrust bearings and it would completely seize-the assembly. If this bore was too short, then the bottom adaptor would obviously stop short and the longitudinal movement would be excessive.

The lower secondary thrust bearing 904 may be disposed on an upper end of the drive bearing housing 1200. The drive bearing housing 1200 may be generally formed as a tube with an internal bore that is installed over a middle portion of the mandrel 1000. Near the upper end, the drive bearing housing may include a connection structure for securing the lower secondary thrust bearing 904.

Moving downwards from the upper end, an upper radial bearing assembly 1300, primary thrust bearing assembly 1100, and a lower radial bearing assembly 1400 may all be disposed between the drive bearing housing 1200 and the mandrel 1000.

The upper radial bearing assembly 1300 may include an internal upper radial bearing sleeve 1302 that may be attached to the mandrel 1000 exterior surface at location lower than the lower secondary thrust bearing 904. In the depicted embodiment, the attachment may be accomplished by a slip fit to a keyed connection and secured with a snap ring placed on the mandrel at an appropriate location. It will be appreciated that this may also be accomplished by placement on threads at the appropriate locations. An external upper radial bearing sleeve 1304 may attached to the drive housing 1200, secured in a recess in the internal bore of the drive housing 1200 over the internal upper radial bearing sleeve 1302. The faces of the bearing sleeves may be a suitable hardened material, such as carbide, PCD or PCBN.

The primary thrust bearing assembly 1100 may be disposed inside the drive bearing housing assembly 1200. In the depicted embodiment, the primary thrust bearing assembly may be disposed between the upper radial bearing assembly 1300 and the lower radial bearing assembly 1400. The primary thrust bearing assembly 1100, includes the upper primary thrust bearing 1102 and a lower primary thrust bearing 1104, each formed as a ring with a lateral face in which a hardened material, such as PCD or PCBN buttons may be disposed. The opposing lateral faces are arranged facing one another.

The lower primary thrust bearing 1104 may be attached to the mandrel 1000 exterior surface at location above the lower radial bearing assembly 1400. In the depicted embodiment, the attachment is above a ridge or shelf formed on the mandrel, such that the lateral face faces upwards. The bearing may be secured by placement on threads. The upper primary thrust bearing 1102 may be attached to the drive housing 1200, secured in a recess in the internal bore of the drive housing 1200, as by placement on threads or use of a suitable adhesive.

The lower radial bearing assembly 1400 may include an internal lower radial bearing sleeve 1402 that may be attached to the mandrel 1000 exterior surface at location below the primary thrust bearing assembly 1100. In the depicted embodiment, the lower radial bearing assembly 1400 is disposed at a lower end of the housing 1200, above the lower connection portion 1004 of the mandrel 1000. The internal lower radial bearing sleeve 1402 that may be attached by placement on threads at the appropriate location. An external lower radial bearing sleeve 1404 may attached to the drive housing 1200, secured in a recess in the internal bore of the drive housing 1200 over the internal lower radial bearing sleeve 1402. The faces of the bearing sleeves may be a suitable hardened material, such as carbide, PCD or PCBN.

It will be appreciated that in addition to PCD, other suitable materials, such as CBN, carbide, or other hardened surfaces can be used for the bearing surfaces, it will be further appreciated that the bearing assemblies are assembled in the correct in position by the assembly of the drive unit that no compressive loading is required before use, especially with respect to the thrust bearings. Instead, such bearings do not carry any load until the motor is in operation and the movement of the motor in use with a tool places forces on the bearings.

Figure 1B:
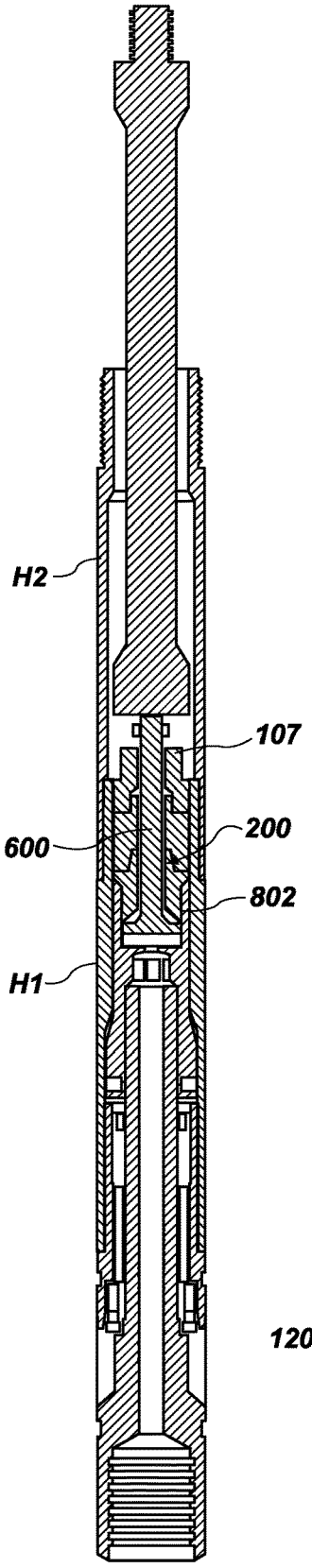
Figure 2A:
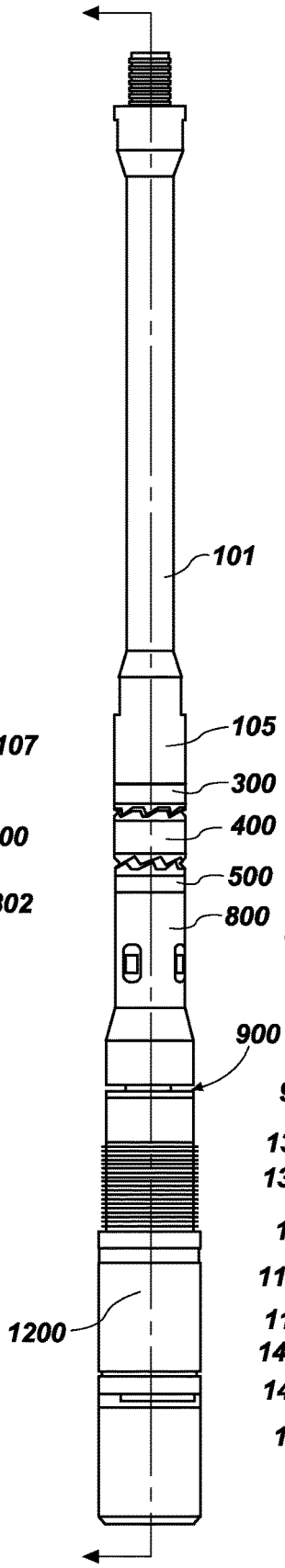
FIGS. 2A and 2B depicts a side view, and a sectional side view, respectively, of the assembled internal components of FIGS. 1A and 1B.
Figure 2B:
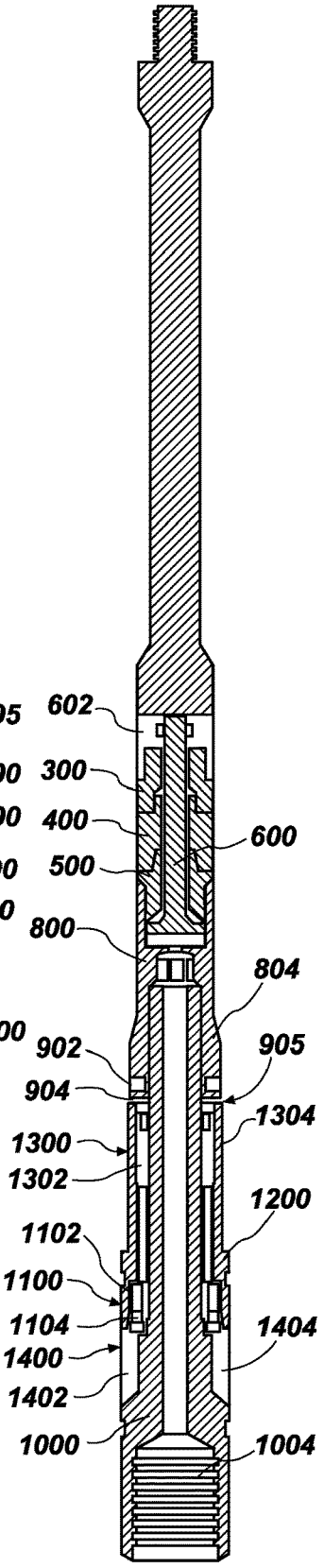

A housing may be used to cover and protect the drive unit bearings and transmission. In the depicted embodiment, a two-part housing is shown. The lower housing H1 may be formed as a tube that is placed over the drive housing 1200 extending upward over at least a portion of the transmission adaptor 800. In its lower portion, the lower housing H1 may include internal threading allowing it to be secured to counterpart external threads on the drive housing 1200. An upper housing H2 may similarly be threadably secured to an upper portion of the lower housing H2 and extend upwards with its internal bore covering the flexible joint and at least a portion of the drive shaft. As depicted in FIGS. 1A and 1B, the lower end of mandrel 1000, the lower end of the drive bearing housing 1200, and the housing H1 and H2 may all have about similar diameters to provide a relatively smooth rounded exterior to reduce friction and facilitate use in a well bore reduce by removing exterior features that may catch. It will be further appreciated that the internal sidewalls of the housing may conform to the internal components, by having thinner and thicker areas to reinforce and retain the components in position.

In one illustrative embodiment, the placement of the bearings inside the motor provides additional protection from debris, such as cuttings, that may be present in a wellbore. Thus, motors including drive units in accordance with the present disclosure may be especially advantageous for use in coal bed methane wells, where the abrasive nature of the cuttings and the conformation required for suitable wellbores can be difficult to achieve with standard motors.

Figure 5:
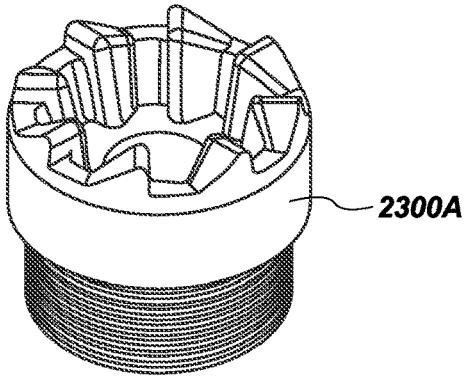
FIG. 5 is an isometric view of one illustrative embodiment of a top member of a flexible CV joint assembly that may be used in the embodiment of FIGS. 3A through 4B in isolation.
Figure 6:
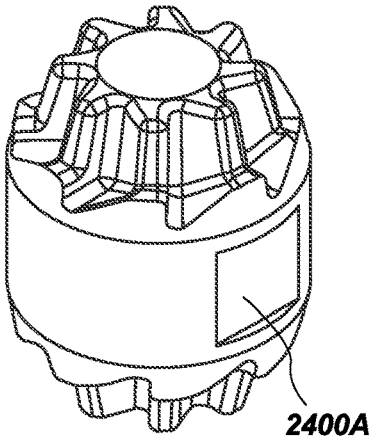
FIG. 6 is an isometric view of one illustrative embodiment of a middle member of a flexible CV joint assembly that may be used in the embodiment of FIGS. 3A through 4B in isolation.

Turning to FIGS. 3A, 3B, 4A and 4B, a second illustrative embodiment of a drive unit 20 for a downhole motor in accordance with the present disclosure is depicted. It will be appreciated that the drive unit may be connected to a stator housing (not shown) that includes a top sub for attachment to a drill string, and an internal rotor that is actuated by drilling fluid. At top end of the drive unit 20, a drive connection member 2102 has a threaded upper end 2103 for attachment to a rotor and a lower end 2105 that may include an internally threaded bore 2107 for attachment to a first flexible joint assembly 2200A The flexible joint assembly 2200A may be formed as a multi-part CV joint. In the depicted embodiment, the flexible joint assembly 2200A may include three interlocking members: an upper member 2300A, a middle member 2400A and a lower member 2500A. Each member has an internal bore, which are commonly aligned upon assembly. One suitable embodiment of an upper member 2300A is depicted in isolation in FIG. 5 to show additional details thereof. It will be appreciated that for ease of assembly, the depicted upper member 2300A may be identical to lower member 2500A, simply inverted for use. Similarly, one suitable embodiment of a middle member 2400A is depicted in isolation in FIG. 6 to show additional details thereof.

Figure 7:
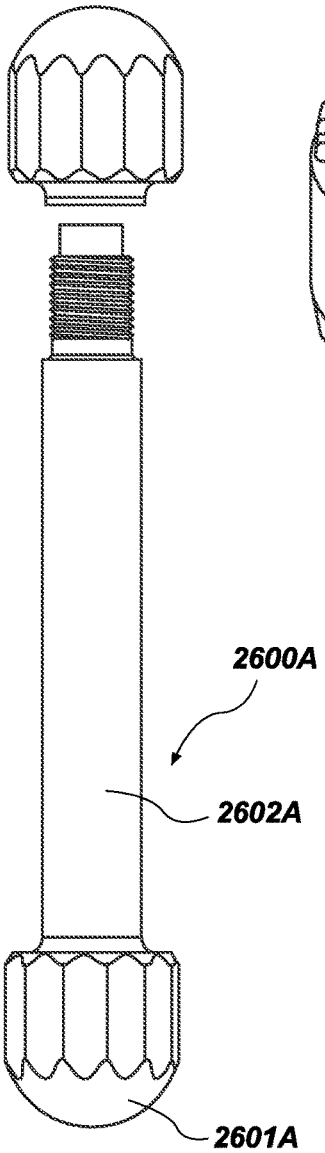
FIG. 7 is a side view of one illustrative embodiment of a retention pin assembly of a flexible CV joint assembly that may be used in the embodiment of FIGS. 3A through 4B in isolation.

A retention pin 2600A extends from a lower base with a rounded bottom 2601A to an upwardly extending shaft 2602A that passes through the commonly aligned bores of the interlocking members. A retaining cap 2603A may be threadably secured around an upper portion of the shaft 2602A. The retaining cap 2603A may have a rounded upper surface, similar to that of the lower base 2601A. One suitable embodiment of a retention pin 2600A and a retaining cap 2603A are depicted in isolation in FIG. 7 to show additional details thereof.

An upper articulating plate 2613A may be de disposed in the internal bore 2107 of the drive connection member 2102 at an upper end thereof. A lower face of the articulating plate 2613A contains a recess that corresponds to the rounded end of the retaining cap 2603A. Similarly, a lower articulating plate 2615A may be disposed in the upper internal bore 2117 of the connection shaft 2110 at an upper end thereof. An upper face of the lower articulating plate 2615A contains a recess that corresponds to the rounded end rounded bottom base of the retention pin 2600A.

In use, the rounded ends of the retention pin assembly can articulate in the articulating plates, providing additional flexibility to the flexible joint assembly. Additionally, the shaft of the pin 2600A provides a limit on the compression of the assembly, thus keeping at least a minimum space available for longitudinal movement between the interlocking members.

As depicted, the three interlocking members include respective interlocking portions which may be formed as a series of recessed splines that are separated by recesses. It will be appreciated that the splines and recesses of each interlocking portion may correspond to the recesses and splines of the counterpart interlocking portion of the adjacent interlocking member. In an assembled form, the corresponding adjacent interlocking portions of the interlocking members are inserted into one another as depicted. As depicted, the middle member 2400A may be male to male, or have generally protruding interlocking portions on either end, and the upper member 2300A and lower member 2500A have female, or recessed interlocking portions. It will be appreciated that the arrangement of the particular interlocking portions may vary in different embodiments.

Lower member 2500A may have a lower connection portion for connection to connection shaft 2110. In the depicted embodiment, the lower connection portion may include external threads 2502A that can be attached to corresponding threads in the upper internal bore 2117 of the connection shaft 2110.

It will be appreciated that the recesses and splines of the interlocking portions of the members of the flexible joint may extend both in a generally top-to-bottom direction aligned with a long axis of the motor assembly, and in a generally lateral direction to allow the members to move in both directions, such that the flexible joint can provide rotational powered drive to the connection shaft 2110, while allowing the members 2300A, 2400A and 2500A to move angularly with respect to one another on the pin 2600A, providing flexibility and accounting for eccentricities in the rotation as power is applied.

It will be appreciated that in other embodiments, the internal vs. external positioning of the various interlocking portions, and the particular number and shape of the splines and recesses may vary, so long as the ability to transmit the rotational power while providing the requisite flexibility is provided. It will be appreciated that in other embodiments, one or more additional middle section member may be present to provide for increased flexibility. For example, two or three middle members could be used with a suitable one pin 2600A.

Connection shaft 2110 extends downwards to a lower portion 2120 that may include an internally threaded bore 2127 accessible at its lower end for attachment to a second flexible joint assembly 2200B.

Similar to the first flexible joint assembly 2200A, discussed previously herein, the second flexible joint assembly 2200B may be formed as a multi-part CV joint. In the depicted embodiment, the flexible joint assembly 2200B may include three interlocking members: an upper member 2300B, a middle member 2400B and a lower member 2500B. Each member has an internal bore, which are commonly aligned upon assembly. For ease of assembly the components of the second flexible joint assembly 2200B may be identical to those of first flexible joint assembly 2200A.

A retention pin 2600B may extend from a lower base with a rounded bottom 2601B to an upwardly extending shaft 2602B that passes through the commonly aligned bores of the interlocking members. A retaining cap 2603B may be threadably secured around an upper portion of the shaft 2602B. The retaining cap 2603B may have a rounded upper surface, similar to that of the lower base 2601B.

An upper articulating plate 2613B may be de disposed in the internal bore 2127 of the lower portion of the connection shaft 2110 at an upper end thereof. A lower face of the articulating plate 2613B may contain a recess that corresponds to the rounded end of the retaining cap 2603B. Similarly, a lower articulating plate 2615B may be disposed in the upper internal bore 2803 of the bottom adaptor 2800. An upper face of the lower articulating plate 2615B may contain a recess that corresponds to the rounded end rounded bottom base of the retention pin 2600B. It will be appreciated that in some embodiments, rather than using separate articulating plates, the articulating recesses can be disposed directly in the attached to the upper and/or lower interconnecting members. The use of articulating plates allows their replacement when advantageous due to wear.

In use, the rounded ends of the retention pin assembly can articulate in the articulating plates, providing additional flexibility to the flexible joint assembly. Additionally, the shaft of the pin 2600B provides a limit on the compression of the assembly, thus keeping at least a minimum space available for longitudinal movement between the interlocking members.

As depicted, the three interlocking members include respective interlocking portions which may be formed as a series of recessed splines that are separated by recesses. It will be appreciated that the splines and recesses of each interlocking portion may correspond to the recesses and splines of the counterpart interlocking portion of the adjacent interlocking member. In an assembled form, the corresponding adjacent interlocking portions of the interlocking members are inserted into one another as depicted. As depicted, the middle member 2400B may be male to male, or have generally protruding interlocking portions on either end, and the upper member 2300B and lower member 2500B have female, or recessed interlocking portions. It will be appreciated that the arrangement of the particular interlocking portions may vary in different embodiments.

Lower member 2500B may have a lower connection portion for connection to bottom adaptor 2800. In the depicted embodiment, the lower connection portion may include external threads 2502B. Bottom adaptor 2800 has an upper connection portion 2802, that is adapted to connect to the lower interlocking member 2500B, as by a threaded receptacle. At a lower end, a mandrel connection portion 2804 allows for connection to the mandrel 3000, as by having a threaded receptacle accessible from the lower surface. Additionally, the lower surface may have a connection for the upper secondary thrust bearing 2902. In the depicted embodiment, this may be an external thread to which the upper secondary thrust bearing 2902 is secured.

It will be appreciated that the mandrel 3000, extends from a lower connection portion 3004 at a bottom, which may be a threaded receptacle allowing connection to a drill bit or other tool to which the rotational power is to be provided, to the upper end, which may include a connection structure for connection to the bottom adapter 2800, such as an externally threaded portion. Further, it will be appreciated that the "on-bottom/off-bottom" longitudinal movement of the mandrel/drive-sub is much reliant on the bottom adaptor 2800 to mandrel 3000 connection. The upper end of the internal bore of that adapter 2800 serves as a 'stop-point' and thus defines the 'gap' for longitudinal movement of the mandrel 3000. If this bore is too long, then the bottom adaptor would be able to thread down and load out the thrust bearings and it would completely seize-the assembly. If this bore was too short, then the bottom adaptor would obviously stop short and the longitudinal movement would be excessive. In the depicted embodiment an ideal "gap" for movement of the mandrel in the longitudinal direction may be about 0.100 inches.

Figure 8A:
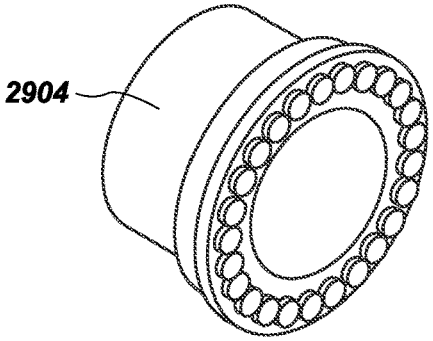
FIG. 8A is an isometric view of one illustrative embodiment of a lower secondary thrust bearing that may be used in the embodiment of FIGS. 3A through 4B in isolation.
Figure 9A:
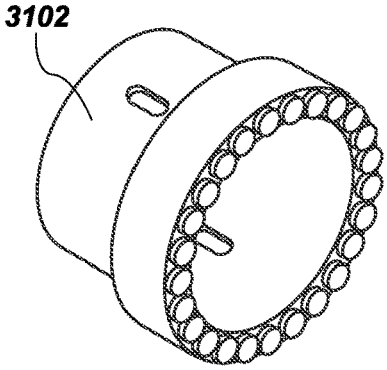
FIG. 9A is an isometric view of one illustrative embodiment of an upper primary bearing that may be used in the embodiment of FIGS. 3A through 4B in isolation.
Figure 9B:
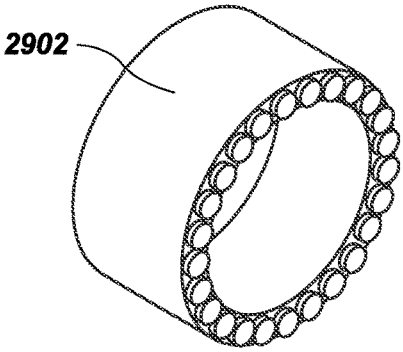
FIG. 9B is an isometric view of one illustrative embodiment of an upper secondary thrust bearing that may be used in the embodiment of FIGS. 3A through 4B in isolation.

The secondary thrust bearing assembly 2900, includes the upper secondary thrust bearing 2902 and a lower secondary thrust bearing 2904, Each of the upper secondary thrust bearing 2902 and the lower secondary thrust bearing 2904, may be a ring with an opposing lateral face, in which a hardened material, such as PCD or PCBN buttons are disposed facing the opposing thrust bearing. One set of suitable embodiments of a upper secondary thrust bearing 2902 and a lower secondary thrust bearing 2904 are depicted in isolation in FIGS. 9B and 8A to show additional details thereof.

Unlike the embodiment depicted in FIGS. 1A through 2B, rather than a gap being present between the upper secondary thrust bearing 2902 and a lower secondary thrust bearing 2904, a chamber 907 may be disposed beneath the upper portion of the lower secondary thrust bearing 2904, and a spring 2908 disposed therein that presses upwards on to the bearing to keep contact between the upper and lower bearings. Spring 2908 may thus respond to movement of the mandrel when taken from the "off-bottom" to the "on-bottom" position and vice versa.

The lower secondary thrust bearing 2904 may be disposed on an upper end of the drive bearing housing 3200, as by using a slip fit to a keyed connection or other suitable connection, with chamber 2907 defined between lower sidewall of the secondary thrust bearing and the internal wall of the drive housing 3200. The drive bearing housing 3200 may be generally formed as a tube with an internal bore that is installed over a middle portion of the mandrel 3000.

Moving downwards from the upper end, an upper radial bearing assembly 3300, primary thrust bearing assembly 3100, and a lower radial bearing assembly 3400 may all be disposed between the drive bearing housing 3200 and the mandrel 3000.

The upper radial bearing assembly 3300 may include an internal upper radial bearing sleeve 3302 that may be attached to the mandrel 3000 exterior surface at location lower than the lower secondary thrust bearing 2904. In the depicted embodiment, the attachment may be accomplished by a slip fit to a keyed connection and secured with a snap ring placed on the mandrel at an appropriate location. It will be appreciated that this may also be accomplished by placement on threads at the appropriate locations. An external upper radial bearing sleeve 3304 may be attached to the drive housing 3200, secured in a recess in the internal bore of the drive housing 3200 over the internal upper radial bearing sleeve 3302. The faces of the bearing sleeves may be a suitable hardened material, such as carbide, PCD or PCBN.

Figure 8B:
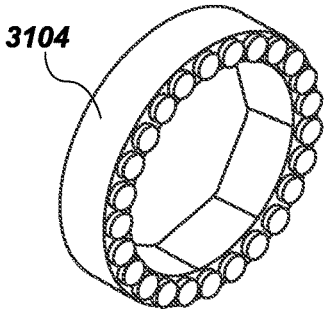
FIG. 8B is an isometric view of one illustrative embodiment of a lower primary thrust bearing that may be used in the embodiment of FIGS. 3A through 4B in isolation.

The primary thrust bearing assembly 3100 may be disposed inside the drive bearing housing assembly 3200. In the depicted embodiment, the primary thrust bearing assembly may be disposed between the upper radial bearing assembly 3300 and the lower radial bearing assembly 3400. The primary thrust bearing assembly 3100, includes the upper primary thrust bearing 3102 and a lower primary thrust bearing 3104, each formed as a ring with a lateral face in which a hardened material, such as PCD or PCBN buttons may be disposed. The opposing lateral faces are arranged facing one another. One set of suitable embodiments of an upper primary thrust bearing 3102 and a lower primary thrust bearing 3104 are depicted in isolation in FIGS. 9A and 8B to show additional details thereof.

The lower primary thrust bearing 3104 may be attached to the mandrel 3000 exterior surface at location above the lower radial bearing assembly 3400. In the depicted embodiment, the attachment is above a ridge or shelf formed on the mandrel, such that the lateral face faces upwards. In the depicted embodiment, the attachment may be a simple slip fit over a keyed connection on a retaining ring which threads onto the mandrel 3000 just above the lower radial bearing 3402. In addition to providing a slip fit keyed surface for the lower primary thrust bearing 3104 to slide onto, such a ring can act as a "safety" retaining ring to prevent the lower radial bearing 3402 from backing off, as it may be threaded onto the shaft with a different thread pitch from the radial bearing thread pitch. In other embodiments, the lower primary thrust bearing 3104 may be secured by placement on threads directly on the mandrel.

The upper primary thrust bearing 3102 may attached to the drive housing 3200. Unlike the embodiment depicted in FIGS. 1A through 2B, rather than a gap being present between the upper and lower primary thrust bearings 3102 and 3104, a chamber 3107 may be disposed above the lower portion of the upper primary thrust bearing 3102, and a spring 3108 disposed therein that presses downwards on the bearing to keep contact between the upper and lower bearings. Spring 3108 may thus respond to the movement of the mandrel when taken from the "off-bottom" to the "on-bottom" position and vice versa. The movement allowed by springs 3108 and 2908 may be equivalent and the spring recesses 3107 and 2907 may be similarly sized to allow for the use of identical springs to facilitate assembly.

The lower radial bearing assembly 3400 may include an internal lower radial bearing sleeve 3402 that may be attached to the mandrel 3000 exterior surface at location below the primary thrust bearing assembly 3100. In the depicted embodiment, the lower radial bearing assembly 3400 is disposed at a lower end of the housing 3200, above the lower connection portion 3004 of the mandrel 3000. The internal lower radial bearing sleeve 3402 may be attached by placement on threads at the appropriate location. An external lower radial bearing sleeve 3404 may attached to the drive housing 3200, secured in a recess in the internal bore of the drive housing 3200 over the internal lower radial bearing sleeve 3402. The faces of the bearing sleeves may be a suitable hardened material, such as carbide, PCD or PCBN.

It will be appreciated that in addition to PCD, other suitable materials, such as CBN, carbide, or other hardened surfaces can be used for the bearing surfaces, it will be further appreciated that the bearing assemblies are assembled in the correct in position by the assembly of the drive unit that no significant compressive loading is required before use, especially with respect to the thrust bearings. The springs 3108 and 2908 merely keep the respective thrust bearing assemblies in contact to prevent them from colliding during movement from on-bottom to off-bottom position or vice versa in order to prevent potential impact damage. In the depicted embodiment, the springs 3108 and 2908 may exert a vertical force in the range of about 42 pounds or less, for example in range of 40 to 42 pounds. This is in contrast to prior art designs where a ratchet or compressive assemblies that keep the thrust bearings under significant load are used. Instead, the thrust bearing assemblies do not carry any significant load until the motor is in operation and the movement of the motor in use with a tool places forces on the bearings. Further, it will be appreciated that the springs may provide the bearings with a range of motion in excess of the anticipated longitudinal movement (or "gap") to ensure that the bearing faces remain in contact. It is noted that unlike many current motor designs that use carbide or roller bearings, the current design uses this unique approach to protect PCD bearing surfaces from impact damage. The use of PCD bearing surfaces is intended to create longer service intervals for the drive section and the lower friction coefficient should improve performance and longevity of other in or components.

Figures 3A, 3B, 4A, 4B:
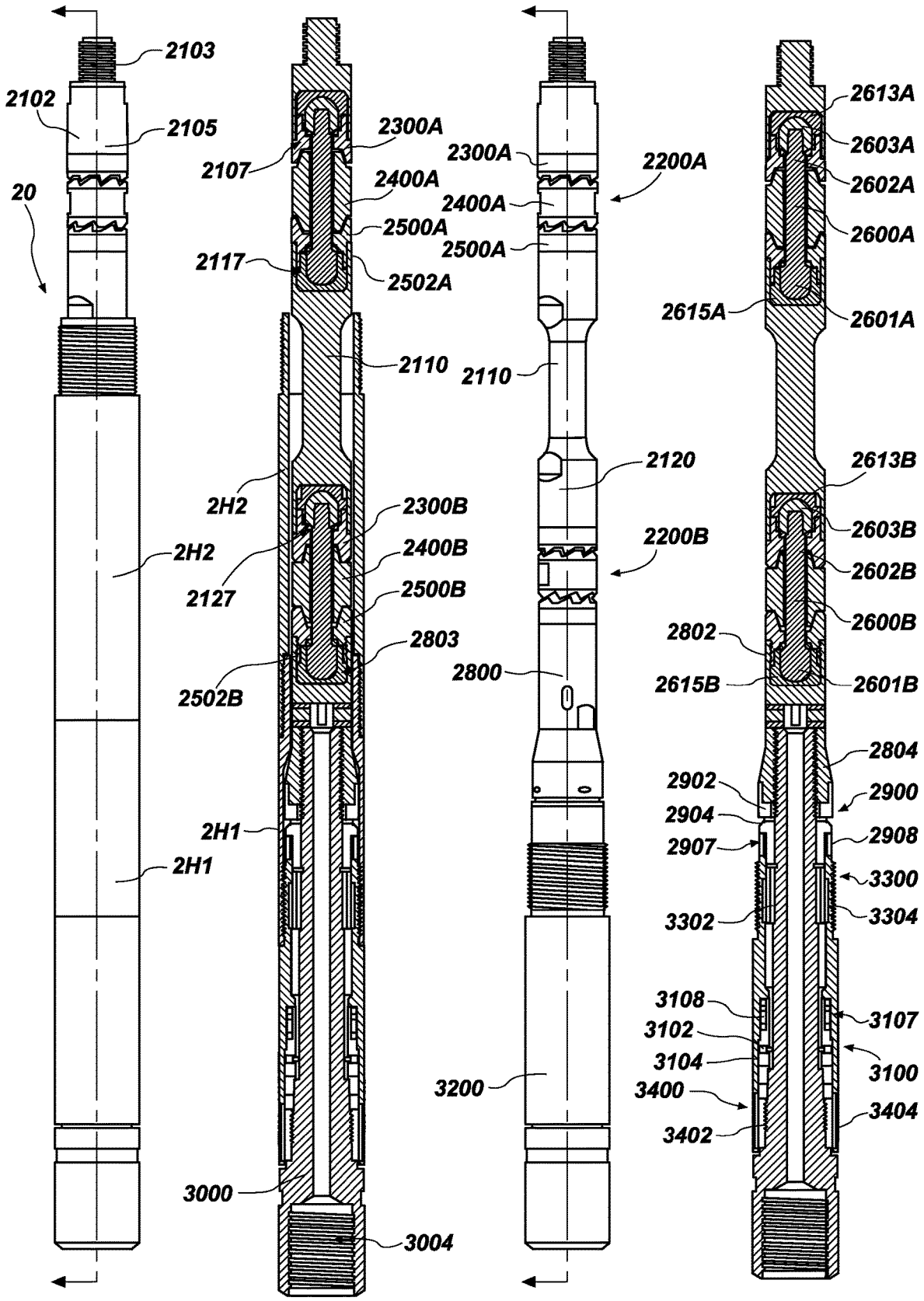
FIGS. 3A and 3B depicts a side view, and a sectional side view, respectively, of another illustrative embodiment of a drive unit for a downhole motor in accordance with the present disclosure.
FIGS. 4A and 4B depicts a side view, and a sectional side view, respectively, of the assembled internal components of FIGS. 3A and 3B.

A housing may be used to cover and protect the drive unit bearings and adaptor. In the depicted embodiment, a two-part housing is shown. The lower housing 2H1 may be formed as a tube that is connected to the drive housing 3200 extending upward over at least a portion of the bottom adaptor 2800. In its lower portion, the lower housing 2H1 may include internal threading allowing it to be secured to counterpart external threads on the drive housing 3200. An upper housing 2H2 may similarly be threadably secured to an upper portion of the lower housing 2H1 and extend upwards with its internal bore covering the second or lower flexible joint and at least a portion of the connection shaft. As depicted in FIGS. 3A and 3B, the lower end of mandrel 3000, the lower end of the drive bearing housing 3200, and the housing 2H1 and 2H2 may all have about similar diameters to provide a relatively smooth rounded exterior to reduce friction and facilitate use in a well bore reduce by removing exterior features that may catch. It will be further appreciated that the internal sidewalls of the housing may conform to the internal components, by having thinner and thicker areas to reinforce and retain the components in position.

It will be appreciated that motor designs in accordance with the present disclosure utilize components that simply are stacked and easily attached to one another (as by slip fit, threading, and snap rings). By contrast most known downhole motor bearing assemblies can be finicky and troublesome to align as the components are stacked and pre-loaded. This eases the assembly process, saving time. Additionally, both the internal nature of the bearing assemblies and the elimination of springs and "pre-load" components provide for longer service intervals, reducing costs and downtime for use.

Reference throughout this specification to "an example" means that a particular feature, structure, or characteristic described in connection with the example is included in at least one embodiment of the present disclosure. Thus, appearances of the phrase "in an example" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on its presentation in a common group without indications to the contrary. In addition, various embodiments and examples of the present disclosure may be referred to herein along with alternatives for the various components thereof. It is understood that such embodiments, examples, and alternatives are not to be construed as de facto equivalents of one another, but are to be considered as separate and autonomous representations of the present disclosure.

Although the foregoing has been described in some detail for purposes of clarity, it will be apparent that certain changes and modifications may be made without departing from the principles thereof. It should be noted that there are many alternative ways of implementing both the processes and apparatuses described herein. Accordingly, the present embodiments are to be considered illustrative and not restrictive.

Those having skill in the art will appreciate that many changes may be made to the details of the above-described embodiments without departing from the underlying principles of the disclosure. The scope of the present disclosure should, therefore, be determined only by the claims, if any.

The invention claimed is:

1. A drive unit for a downhole motor, comprising:

a connection shaft;

at least a first multi-part sectional constant velocity joint with increased flexibility attached to a first end of the connection shaft, wherein the multi-part sectional constant velocity joint comprises:

at least a first top member having a longitudinal bore, an upper attachment section for attachment to the first end of the connection shaft, and a lower interlocking portion;

at least a first middle member having a longitudinal bore, an upper interlocking portion, and a lower interlocking portion;

at least a first lower member having a longitudinal bore, an upper interlocking portion; and at least a first connection pin extending through the longitudinal bores of the top member, the at least first middle member, and the lower member to align and secure the members for use, wherein the lower interlocking portion of the at least first top member, the upper interlocking portion of the at least first middle member, the lower interlocking portion of the at least first middle member, and the upper interlocking portion of the at least first lower member each comprise a series of recesses and splines, such that the adjacent interlocking portions are inserted into one another to allow flexible movement while maintaining sufficient contact between the members that rotational powered drive can be applied through the multi-part sectional constant velocity joint; and a mandrel in operative connection with the at least first multi-part sectional constant velocity joint, such that when rotational force is applied to the connection shaft, the rotational force is transmitted to the mandrel.

2. The drive unit of claim 1, further comprising a second multi-part sectional constant velocity joint with increased flexibility, the second multi-part sectional constant velocity joint attached to a second end of the connection shaft.

3. The drive unit of claim 2, wherein the second multi-part sectional constant velocity joint comprises:

a second top member having a longitudinal bore, an upper attachment section for attachment to a drive connection member, and a lower interconnection portion with a series of splines and recesses;

at least a second middle member having a longitudinal bore, an upper interconnection portion with a series of splines and recesses corresponding to the lower interconnection portion of the at least first top member, and a lower interconnection portion with a series of splines and recesses;

a second lower member having a longitudinal bore, an upper interconnection portion with a series of splines and recesses corresponding to the lower interconnection portion of the at least first middle member and a lower attachment section for attachment to a second end of the connection shaft; and a second connection pin extending through the longitudinal bores of the second top member, at least second middle member, and second lower member to align and secure the members for use.

4. The drive unit of claim 1, wherein the at least first connection pin has a base with a rounded bottom that articulates in a first curved recess.

5. The drive unit of claim 4, further comprising a retaining cap disposed on the at least first connection pin, the retaining cap having a rounded upper surface that articulates in a second curved recess.

6. The drive unit of claim 1, wherein the upper interconnection portion and the lower interconnection portion of the at least first top member are each formed as a protrusion extending from a middle portion of the at least first middle member.

7. The drive unit of claim 1, wherein the at least first lower member comprises a lower attachment section for attachment to an upper end of the mandrel.

8. The drive unit of claim 7, further comprising a housing;

a primary thrust bearing assembly disposed between the housing and the mandrel at a first position; and a secondary thrust bearing assembly disposed between the housing and the mandrel at a second position, wherein the primary thrust bearing assembly and the secondary thrust bearing assembly are maintained in position by other structural components of the motor without compressive loading that prevents longitudinal movement of the mandrel.

9. The drive unit of claim 8, wherein the primary thrust bearing comprises a lower primary thrust bearing element, an upper primary thrust bearing element, and a primary thrust bearing spring residing in a primary thrust bearing spring recess to urge the upper primary thrust bearing element downwards to contact the lower primary thrust bearing element, wherein the primary thrust bearing spring expands or contracts in response to mandrel movement between the on-bottom and off-bottom positions during use.

10. The drive unit of claim 8, wherein the secondary thrust bearing comprises an upper secondary thrust bearing element, a lower secondary thrust bearing element, and a secondary thrust bearing spring residing in a secondary thrust bearing spring recess to urge the lower secondary thrust bearing element upwards to contact the upper secondary thrust bearing element, wherein the secondary thrust bearing spring expands or contracts in response to mandrel movement between the on-bottom and off-bottom positions during use.

11. A drive assembly for a downhole motor, comprising:

a drive shaft;

at least a first multi-part sectional constant velocity joint with increased flexibility attached to a first end of the drive shaft;

a mandrel attached to the at least first multi-part sectional constant velocity joint;

a housing;

a primary thrust bearing assembly disposed between the housing and the mandrel at a first position, the primary thrust bearing assembly comprising a lower primary thrust bearing element, an upper primary thrust bearing element, and a primary thrust bearing spring residing in a primary thrust bearing spring recess to urge the upper primary thrust bearing element downwards to contact the lower primary thrust bearing element, wherein the primary thrust bearing spring expands or contracts in response to mandrel movement between the on-bottom and off-bottom positions during use; and a secondary thrust bearing assembly disposed between the housing and the mandrel at a second position, wherein the primary thrust bearing assembly and the secondary thrust bearing assembly are maintained in position by other structural components of the motor without compressive loading that prevents longitudinal movement of the mandrel.

12. The drive assembly of claim 11, wherein the secondary thrust bearing assembly comprises an upper secondary thrust bearing element, a lower secondary thrust bearing element, and a secondary thrust bearing spring residing in a secondary thrust bearing spring recess to urge the lower secondary thrust bearing element upwards to contact the upper secondary thrust bearing element, wherein the secondary thrust bearing spring expands or contracts in response to mandrel movement between the on-bottom and off-bottom positions during use.

13. The drive assembly of claim 11, wherein the at least first multi-part sectional constant velocity joint comprises a top member having a longitudinal bore, an upper attachment section for attachment to the first end of the connection shaft, and a lower interconnection portion with a series of splines and recesses;

at least a first middle member having a longitudinal bore, an upper interconnection portion with a series of splines and recesses corresponding to the lower interconnection portion of the at least first top member, and a lower interconnection portion with a series of splines and recesses;

a lower member having a longitudinal bore, an upper interconnection portion with a series of splines and recesses corresponding to the lower interconnection portion of the at least first middle member; and at least a first connection pin extending through the longitudinal bores of the top member, at least first middle member, and lower member to align and secure the members for use.

14. The drive assembly of claim 13, wherein the at least first connection pin has a base with a rounded bottom that articulates in a curved recess.

15. The drive assembly of claim 11, further comprising a second multi-part sectional constant velocity joint with increased flexibility, the second multi-part sectional constant velocity joint attached to a second end of the drive shaft.

16. The drive assembly of claim 11, further comprising a first radial bearing assembly comprising a first internal radial bearing sleeve attached to an exterior surface of the mandrel and a first outer radial bearing sleeve attached to the housing and aligned with first internal radial bearing sleeve.

17. The drive assembly of claim 11, wherein the first radial bearing assembly is disposed at a location lower than the lower secondary thrust bearing and the drive assembly further comprises a second radial bearing assembly is disposed at a location below the primary thrust bearing assembly.

18. A downhole motor, comprising:

a housing;

a mandrel;

a primary thrust bearing assembly disposed between the housing and the mandrel at a first position, the primary thrust bearing assembly comprising a lower primary thrust bearing element, an upper primary thrust bearing element, and a primary thrust bearing spring residing in a primary thrust bearing spring recess to urge the upper primary thrust bearing element downwards to contact the lower primary thrust bearing element, such that the primary thrust bearing assembly is maintained in position by the primary thrust bearing spring expanding or contracting in response to longitudinal mandrel movement; and a secondary thrust bearing assembly disposed between the housing and the mandrel at a second position, the secondary thrust bearing assembly comprising an upper secondary thrust bearing element, a lower secondary thrust bearing element, and a secondary thrust bearing spring residing in a secondary thrust bearing spring recess to urge the lower secondary thrust bearing element upwards to contact the upper secondary thrust bearing element, such that the secondary thrust bearing is maintained in position by the secondary bearing spring expanding or contracting in response to longitudinal mandrel movement.

19. The downhole motor of claim 18, further comprising a first radial bearing assembly comprising a first internal radial bearing sleeve attached to an exterior surface of the mandrel and a first outer radial bearing sleeve attached to the housing and aligned with first internal radial bearing sleeve.

20. The downhole motor of claim 18, further comprising a drive shaft, and at least one multi-part sectional constant velocity joint in operative connection with the mandrel, such that when rotational force is applied to the drive shaft, the rotational force is transmitted to the mandrel, the at least one multi-part sectional constant velocity joint comprising a top member having a longitudinal bore, an upper attachment section for attachment to the first end of the drive shaft, and a lower interconnection portion with a series of splines and recesses, at least a first middle member having a longitudinal bore, an upper interconnection portion with a series of splines and recesses corresponding to the lower interconnection portion of the at least first top member, and a lower interconnection portion with a series of splines and recesses, a lower member having a longitudinal bore, an upper interconnection portion with a series of splines and recesses corresponding to the lower interconnection portion of the at least first middle member, and at least a first connection pin extending through the longitudinal bores of the top member, at least first middle member, and lower member to align and secure the members for use.

* * * * *